US009334667B2

(12) United States Patent
Wijning et al.

(10) Patent No.: US 9,334,667 B2
(45) Date of Patent: May 10, 2016

(54) MODULAR DRILLING RIG SYSTEM

(71) Applicant: ITREC B.V., Schiedam (NL)

(72) Inventors: Diederick Bernardus Wijning, Schiedam (NL); Joop Roodenburg, Delft (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 14/853,811

(22) Filed: Sep. 14, 2015

(65) Prior Publication Data

US 2016/0002946 A1 Jan. 7, 2016

Related U.S. Application Data

(62) Division of application No. 14/383,489, filed as application No. PCT/NL2013/050132 on Mar. 1, 2013, now Pat. No. 9,228,394.

(60) Provisional application No. 61/607,309, filed on Mar. 6, 2012, provisional application No. 61/657,455, filed on Jun. 8, 2012.

(51) Int. Cl.

| | |
|---|---|
| ***E04H 12/34*** | (2006.01) |
| ***E21B 7/02*** | (2006.01) |
| ***E21B 15/00*** | (2006.01) |
| ***E21B 19/20*** | (2006.01) |
| ***E21B 19/14*** | (2006.01) |
| ***E04B 1/19*** | (2006.01) |
| ***E04B 1/343*** | (2006.01) |
| ***E04B 1/344*** | (2006.01) |
| ***E04H 12/18*** | (2006.01) |

(52) U.S. Cl.

CPC ..... *E04H 12/345* (2013.01); *E04B 1/19* (2013.01); *E04B 1/344* (2013.01); *E04B 1/34336* (2013.01); *E04H 12/187* (2013.01); *E21B 7/02* (2013.01); *E21B 15/00* (2013.01); *E21B 19/14* (2013.01); *E21B 19/20* (2013.01)

(58) Field of Classification Search

CPC ..... E21B 7/02; E21B 7/023; E21B 7/026; E21B 15/00; E21B 19/14; E21B 19/20

See application file for complete search history.

(56) References Cited

U.S. PATENT DOCUMENTS

| | | | |
|---|---|---|---|
| 3,228,151 | A | 1/1966 | Woolslayer et al. |
| 4,473,977 | A | 10/1984 | Reed |
| 7,828,087 | B2 | 11/2010 | Vora |
| 7,905,300 | B2 | 3/2011 | Rieder et al. |
| 2005/0241823 | A1 | 11/2005 | Beato et al. |
| 2007/0074460 | A1 | 4/2007 | Belik |
| 2011/0072737 | A1 | 3/2011 | Wasterval |

FOREIGN PATENT DOCUMENTS

WO WO 2013/109147 A2 7/2013

*Primary Examiner* — Patrick Maestri

(74) *Attorney, Agent, or Firm* — Birch, Stewart, Kolasch & Birch, LLP

(57) ABSTRACT

Modular transfigurable drilling rig system composed of multiple components, which system is transfigurable between a transport mode in which the components of the system are transportable and an operational mode in which the components are assembled to a drilling rig which is adapted to drill into a well centre in the ground.

16 Claims, 5 Drawing Sheets

MODULAR DRILLING RIG SYSTEM

This application is a Divisional of application Ser. No. 14/383,489 filed on Sep. 5, 2014, which is the national phase of PCT International Application No. PCT/NL2013/050132 filed on Mar. 1, 2013, and which claims priority to U.S. Provisional Application Nos. 61/607,309 filed on Mar. 6, 2012 and 61/657,455 filed on Jun. 8, 2012. The entire contents of all of the above applications are hereby incorporated by reference.

The present invention relates to a modular drilling rig system.

Modular drilling rigs have been used in the oil and gas industry, both in offshore drilling industry and on land for a considerable time. An early example of such a modular drilling rig is described in U.S. Pat. No. 3,228,151. In this document a drilling apparatus is disclosed comprising a base substructure having a base, an elevatable drilling floor and means between them for raising the floor, preferable hingable legs. A mast is provided, having rear legs extending upward from the substructure and front legs extending downward in front of the substructure, pivotal means supporting the front legs. The mast is swingable on said pivotal means.

It is an aim of the invention to provide a more efficient modular drilling rig system.

According to the present invention this is achieved by a modular transfigurable drilling rig system composed of multiple components, which system is transfigurable between a transport mode in which the components of the system are transportable by vehicles and an operational mode in which the components are assembled to a drilling rig which is adapted to drill into a well centre in the ground, the system comprising:

- a drilling rig mast which is movable between a substantially horizontal connecting position and an operational position substantially vertically above the well centre, the drilling rig mast having a top end and a foot,
- a base structure adapted to be positioned in the operational mode on a surface near the well centre to support the drilling rig thereon, the base structure comprising a cross beam adapted to be positioned on the surface near the well centre,
- a pedestal adapted to be—in a substantially horizontal connecting position thereof—pivotally connected at a lower end thereof to said base structure, preferably to the cross beam, about a pedestal pivot axis; which pedestal is operable to pivot between the substantially horizontal connecting position and a substantially vertical operational position; which pedestal is adapted to be—in the substantially horizontal connecting position—connected to the foot of the drilling rig mast and adapted to—in the substantially vertical operational position—support the drilling rig mast above the well centre;
- at least one drive assembly to pivot the connected pedestal and drilling rig mast as a unit between the substantially horizontal connecting position and the substantially vertical operational position, such that in the vertical operating position the drilling rig mast is positioned above the well centre,
- a pipe loader for loading pipes such as drill pipes and/or risers into the drilling rig mast, wherein the base structure further comprises at least two elongated base units adapted to be placed on the surface adjacent the cross beam, which base units are each connectable to the cross beam to form a C-arrangement when seen from above, with the legs of the C at the side remote from the well centre, such that said base units extend side-by-side with a spacing there between dimensioned to receive a vehicle carrying at least a foot portion of the drilling rig mast in its substantially horizontal connecting position, such that the foot of the drilling rig mast is arranged between the base units and connectable to the pedestal in its substantially horizontal connecting position; and after the unit formed by the connected pedestal and drilling rig mast has pivoted to the substantially vertical operational position, to receive the pipe loader.

The configuration of the base structure forming a C-arrangement when seen from above is advantageous as the well centre is freely accessible, e.g. to position a BOP (Blow-Out Preventor). Another advantage is that the drilling rig system may be allowed to move away from the well centre, e.g. to move to another well centre nearby. This is in particular advantageous when the base structure is provided with a displacement system as described in application PCT/NL2013/050026 of the same applicant, herewith incorporated by reference. In prior art drilling rig systems, base structures supporting the drilling rig mast are applied which surround the well centre entirely. Also, it is known to position the drawworks or the pipe loader adjacent the well centre, opposite to the drilling rig mast. Another advantage is the increased safety: the sensitive well centre cannot be disturbed during assembly and installation of the drilling rig system.

Preferably, the components of the modular transfigurable drilling rig system, at least of the base structure and of the mast, have dimensions that allow the components to be transported on vehicles, e.g. trucks, e.g. on trailers, over land. In particular, the maximum dimensions of most components, e.g. support beams, base units, displacement devices, mast sections, pipe loader etc. correspond to those of standard ISO freight containers. Possibly one or more components are provided with ISO corner fittings to secure the component during transportation and possibly also for assembly of the rig. Even more preferably, the components also have a limited weight per component, e.g. a maximum weight per component of 25 tons. Such a limited weight may facilitate transport and enable a quick assembly and disassembly of the drilling rig according to the invention.

The modular transfigurable drilling rig system according to the present invention is transfigurable into an operation mode in which the components are assembled to form a drilling rig. In the operational mode the drilling rig of the invention is preferably suitable for drilling processes for the extraction of a natural resource such as ground water, natural gas, or petroleum, for the injection of a fluid from surface to a subsurface reservoir or for subsurface formations evaluation or monitoring. The hole drilled in the earth's surface through which the natural resources are being extracted is called the well centre. In practice, multiple well centres may be present at a single drilling site.

An essential component of the modular transfigurable drilling rig system is a drilling rig mast, having a top end and a foot. In the operational position the mast is positioned vertically above the well centre to perform drilling activities. According to the present invention, the drilling rig mast which is movable between a substantially horizontal connecting position and the operational position. Possibly, the drilling rig mast is composed of multiple transportable mast sections, for example 2-4 sections, preferably three sections, at least including a foot or lower section forming the foot of the drilling rig mast and a top section forming the top of the drilling rig mast. The mast sections need to be assembled end-to-end, and are connected to form a drilling rig mast having a top end and a foot.

The assembly of a drilling mast comprising a top section, a middle section and a lower section and a top drive may be as follows. After the pedestal is connected to the base structure, the lower mast section is supplied, e.g. by a trailer of a road vehicle, and connected to the pedestal. The drive assembly is then operated to raise the lower mast section from the trailer. The middle section is subsequently supplied on a trailer of a vehicle in lying condition. In order to align the upper end of the lower section with the lower end of middle section the lower mast section has been tilted downward to obtain alignment. Then the connection is established only at the adjoining top facing corners or sides of these lower and middle mast sections, this connection forming a temporary hinge. The lower mast section has hooks at the top facing corners, while the middle mast section having mating members to establish a hinged connection. Then the lower mast section is raised again by operating the drive assembly to obtain full alignment of the lower and middle mast sections so that their lower corners also meet and the lower and middle mast sections are then raised somewhat further so that the mast clears the trailer which is then driven away. It is noted that the lower corners of the adjoining lower and middle mast sections are connected yet, as will be explained below.

The middle mast section, and possibly also other mast sections of the mast or portions thereof, has, as is preferred, a c-shaped cross-section with three latticed sides having vertical longitudinal columns at their corners and a lattice framework there between. The middle mast section has one open side, said open side facing downwards when the mast is held in generally horizontal position relative to the base structure. The open side provides an opening to allow for a top drive to be brought into the space within the contour of the mast section.

Before the top mast section is connected to the mast, it is envisaged that the top drive is supplied by a vehicle in horizontal or lying condition as is preferred to facilitate the transportation thereof. As preferred, the top drive lies on a vehicle trailer which is parked underneath the middle mast section that is now held in generally horizontal position.

Subsequently, the mast is lowered by operation of the drive assembly, so that the middle section comes to rest on the trailer. The lower and middle sections assume an angled orientation relative to one another, interconnected by the temporary hinge as explained above. Now the middle section is horizontal on the trailer.

As the open side of the middle mast section is directed downwards at this stage, the top drive—still lying on the trailer—comes into the space defined by the contour of the middle mast section. The top drive is then connected to the middle mast section, e.g. to one or more guide rails extending longitudinally along the middle mast section. For example the middle mast section includes one of more longitudinal guide rails equipped with one or more trolleys thereon, the top drive being connected to the trolley or trolleys, e.g. by bolts. It will be appreciated that another connection arrangement, possibly a merely temporary fastening by slings or ropes, is also possible between the top drive and the mast section.

Subsequently, the lower mast section is raised so that the middle section becomes fully aligned again with the lower mast section, and now the lower corners of these lower and middle sections are securely interconnected, e.g. by locking pins or bolts. Raising lower mast section entails raising the middle mast section and thereby lifting the top drive from the trailer which can then depart.

The top mast section may subsequently be supplied by a vehicle. This top section is preferably connected to the middle mast section in the same way as the connection between the middle mast section and the lower mast section, so that the completed mast can be raised to clear from the trailer which then departs.

Possibly, drilling equipment such as top drive, crown block and travelling block are integrated into one or more of the mast sections for transportation as integrated items. Preferably, the drive assembly is adapted to pivot the connected pedestal and drilling rig mast composed from said mast sections as a unit between the substantially horizontal connecting position and the vertical operational position.

The well centre above which the drilling rig is positioned in the operational mode can be positioned on land or in the water. The drilling rig mast is in the operation position to be provided substantially above the well centre. To this end, a base structure is provided which—in the operational mode—is adapted to be positioned on a surface near the well centre. The base structure is provide to support the drilling rig mast thereon. This surface can be the ground or earths's surface, but can alternatively be an end of a cantilever, or a deck of a vessel, etc. It is noted that whilst the rig according to the invention is primarily proposed for land based drilling activities, e.g. oil, gas (e.g. shale gas), geothermal drilling activities, the same rig may also be employed for drilling offshore. The surface is then formed by a platform, drilling vessel, etc.

The base structure according to the invention is composed of three main base structure components, which are preferably to be transported as separate components: a cross beam (or plate) adapted to be positioned on the surface near the well centre, and at least two elongated base units. Preferably, base units are 40 foot long as an ISO freight container. The elongated base units are adapted to be placed on the surface adjacent the cross beam, which base units are each connectable to the cross beam to form a C-arrangement when seen from above, with the legs of the C at the side remote from the well centre, such that said base units extend side-by-side with a spacing there between. Preferably, each base unit has an axial end face, and the cross beam has a side that is provided with two sets of connector members each for connecting the cross beam to an axial end face of a base units.

Optionally, the base structure further comprises base structure further comprises two parallel support beams adapted to be positioned on the surface perpendicular to the cross beam and adjacent the well centre. These support beams are preferably provided in line with the base units, extending as a continuation of the base units. These support beams may be embodied integral with the base units, or alternatively as separate elements which can be connected to either the cross beam or the base units. In all, the base structure now forms a H-arrangement when seen from above, with legs at the side remote from the well centre formed by the base units, and legs at the side of the well centre formed by the support beams. Preferably, the legs formed by the base units are longer than the legs formed by the support beams.

According to the present invention, a pedestal is provided which is adapted to—in the substantially vertical operational position—support the drilling rig mast above the well centre. In order to allow the drilling rig system according to the present invention to be transfigurable between a transport mode and an operational mode, the pedestal is operable to pivot between a substantially horizontal connecting position and the substantially vertical operational position. The pedestal is adapted to be—in a substantially horizontal connecting position thereof—pivotally connected to said base structure, preferably to the cross beam, about a pedestal pivot axis. Yet alternatively, it is also conceivable that the pedestal is connected to one or both elongated base units of the base structure, or to yet another component of the base structure.

Preferably, the pedestal pivot axis is provided at a fixed, stationary position on the base structure. This position is preferably an elevated position.

Preferably, the pedestal is connected to the base structure at a lower end thereof, wherein 'lower' is defined as the lower portion of the pedestal, when it is in a substantially vertical operation position. In the substantially horizontal connecting position the pedestal is also adapted to be connected to the foot of the drilling rig mast, preferably at an upper end thereof, wherein 'upper' is defined as the upper portion of the pedestal when it is in a substantially vertical operation position. In an embodiment, the foot of the drilling rig mast comprises a mast connection point or member to be connected pivotally to the pedestal pivot axis on the a base structure, preferably the cross beam.

In a preferred embodiment, the pedestal comprises an arm, adapted to be—in the substantially horizontal connecting position—pivotally connected at a lower end thereof to said base structure, and a cantilevered mast support connected to an upper end of the arm, extending upwards in the substantially horizontal connecting position of the pedestal and extending forward of the arm in the substantially vertical operational position, adapted to be—in the substantially horizontal connecting position—connected to the foot of the drilling rig mast and adapted to—in the substantially vertical operational position—support the drilling rig mast above the well centre. The connection with the foot of the drilling rig preferably is a fixed one: it is not necessary for this connection to be pivotable. Hence, the pedestal is essentially shaped as an "L", wherein the longer leg of the L forms the arm, and the short leg forms the cantilevered mast support. Preferably, the pedestal is formed as a one-piece component. Possibly, the pedestal comprises two parallel arms, which are possibly interconnected, and a cantilevered mast support which is supported by the arms, and possibly formed integral with the one or more arms. The length of the arm preferably allows the provision of a BOP below the cantilevered mast support in the operational position of the drilling rig.

According to the present invention, at least one drive assembly is provided to pivot the connected pedestal and drilling rig mast as a unit between the substantially horizontal connecting position and the substantially vertical operational position, such that in the vertical operating position the drilling rig mast is positioned above the well centre.

The drive assembly to raise and lower the connected pedestal and drilling rig mast preferably engages on the pedestal. Alternatively, it is also conceivable that the drive assembly engages on the (foot of the) drilling rig mast. Preferably, the drive assembly includes one or more long telescopic hydraulic jacks, e.g. two hydraulic jacks extending diagonally from the pedestal or (foot of the) drilling mast to the surface. Due to the mechanical construction, it is preferred that the drive assembly engages on the pedestal and not on the drilling rig mast, as the pedestal is of a much more robust configuration.

Alternatively, the drive assembly may include a winch, e.g. a hydraulic winch having one or more hydraulic winch drive motors, and one or more cables. Optionally, the drive assembly is integrated into the base unit and engages on the pedestal. In an embodiment the drive assembly of the base unit is provided with a drum type winch, having a drum onto which a cable is wound. In order to multiply the force exerted by the winch, the cable is preferably passed in a multi-fall arrangement between a first set of sheaves that is connected to the base unit and a second set of sheaves connected to a mobile part of the pedestal. A hydraulic power unit including a pump and hydraulic reservoir may be integrated into the base unit to provide hydraulic power to the winch of the base unit. In a preferred embodiment the winch has one or more hydraulic drive motors and the base unit is provided with a hydraulic power unit including a pump and a reservoir for hydraulic fluid, more preferably the pump having an electric pump motor and the base unit being provided with a fuel powered generator providing electricity for the pump motor and possibly electrical control of the hydraulic system. In addition to a hydraulic winch, more hydraulic actuators may be provided, e.g. a drill floor member actuator as explained herein, and possibly one or more other hydraulic actuators for other additional functions, e.g. moving a floor plate of the drill floor, etc. A control for the hydraulic system can e.g. be embodied for remote control, e.g. an operator carrying a control box as is known in the field of cranes.

The modular transfigurable drilling rig system of the invention further comprises a pipe loader for loading pipes such as drill pipes and/or risers and/or casings into the drilling rig mast. Preferably, the pipe loader is embodied as a compact tubular handling apparatus, which can be transported in a single container, as available by the applicant.

As indicated previously, the inventive drilling rig system comprises a base structure wherein the base units extend side-by-side with a spacing there between. According to the present invention, the spacing is dimensioned to receive a vehicle carrying at least a foot portion of the drilling rig mast in its substantially horizontal connecting position, such that the foot of the drilling rig mast is arranged between the base units and connectable to the pedestal in its substantially horizontal connecting position. In addition, the spacing is dimensioned such that after the unit formed by the connected pedestal and drilling rig mast has pivoted to the substantially vertical operational position, the pipe loader can be received. Hence, upon assembling the drilling rig system the space between the base units is used to assemble the drilling rig mast, and after the mast is in its operational position, the same space between the base units is used to load and unload tubulars using a pipe loader. This has the advantage that the well centre is kept clear both during the installation of the riling rig, and the movement of the drilling rig mast, and during tubular handling with the pipe loader in the operation mode of the drilling rig. This is additionally advantageous in view of safety: the sensitive well centre cannot be disturbed during assembly and installation of the drilling rig system.

Other drilling rig components of the system may include e.g. drill floor members, drawworks, a blow out preventer (BOP), a drillers cabin, pipe tubs, a pipe rack, mud pumps, shaker tanks, etc.

In a possible embodiment, the drilling rig system further comprises one or more drill floor members adapted to form a drill floor in the operational mode, said drilling floor in the operational mode being located at an elevated position above said base structure, wherein the one or more drill floor members are installed in the drilling rig mast once it is in the vertical operating position thereof. It is noted that a drill floor member may include the actual drill floor, e.g. including drill floor plates, but may also be formed by a drill floor frame member on top of or onto which floor plates or the like are to be mounted, e.g. at a later stage. For example, drill floor members that are to be present on opposite sides on the outside of the mast, above the base units, are hoisted onto the mast after it has been erected, or one or more drill members from part of a mast section, e.g. as hinged flaps that can be deployed in the operative position.

It is noted that one can also envisage a system wherein the base units themselves have no drill floor member embodying the drill floor (or part thereof) or supporting the drill floor plates in operational position of the rig, but instead the drill floor member as discussed herein as part of the base unit is substituted for a beam or frame that constitutes a mobile bar member of the four-pedestal. The drill floor member is then no part of the base unit, and is possibly installed later in the mast. For example drill floor members that are to present on opposite side on the outside of the mast, above the base units, are hoisted onto the mast after it has been erected or one or more drill floor members form part of a mast section, e.g. as hinged flaps that can be deployed into operative position.

The provision in a drilling rig system of a pedestal and a drive assembly to pivot the connected pedestal and drilling rig mast as a unit according to the invention is advantageous as this dispenses the use of drilling drawworks for erecting the drilling rig mast. Due to the use of a pedestal which is adapted to be connected to the drilling rig mast, forming a unit which is pivoted to the vertical operating position, there is no need for modification of the drawworks so that they can be dedicated to their function in the drilling process. A disadvantage of using drawworks to pivot the drilling rig mast is that prior to being able to raise the mast the cables of the drawworks need to be reeved between a drawworks location comprising the winches and sheaves provided in the drilling rig mast prior to raising the mast. In addition, this requires the drawworks to be suitable not only to be used during drilling operations, but also to be used to raise the mast. Another disadvantage is that this installation is complex and time-consuming.

The invention allows for an efficient installation once the drilling rig mast and base structure are positioned on the surface near the well centre. Moreover, the provision of a pedestal and drive assembly according to the invention allow for an advantageous embodiment of the drilling rig, in which the drilling rig system further comprises drilling drawworks. The drilling drawworks is preferably embodied as a component which is transportable by a vehicle. In the advantageous embodiment, the drilling rig mast or the pedestal is provided with drawworks connection members adapted to connect the drawworks to the drilling rig mast or the pedestal at an elevated drawworks position. Possibly the drawworks position is spaced above the drill floor. Alternatively, the drawworks position is at the level of the cantilevered mast support of the pedestal. As such, the drawworks are no longer positioned on the ground in the drilling area, but are connected to the drilling rig mast or the pedestal in an elevated drawworks position. The thus achieved clearance of the ground in the drilling area is very advantageous during drilling operations and enables a more efficient drilling process.

Optionally, the pedestal with the drilling mast connected thereto is operable to move from the substantially horizontal connecting position, via the substantially vertical operational position to a tilted position beyond the vertical operating position thereof, in which position the mast is able to connect the drilling drawworks to the drilling rig mast. The drawworks are preferably presented to the drilling rig mast at an elevated position, e.g. by removing them from the vehicle, e.g. by a crane, or by using optional features of the vehicle, such as a movable floor.

Yet alternatively, the drilling rig mast may be provided with a hoist device adapted to hoist a drilling drawworks—with the mast in its vertical operational position—to the elevated drawworks position on the mast. In particular, the drilling rig mast hoist means may comprise a crane provided at the upper end of the drilling rig mast and an auxiliary jib provided adjacent the elevated drawworks position, in which auxiliary jib.

According to an embodiment of the invention, the driller's cabin is positioned on a drill floor member when the drill floor member is in the operational mode. Alternatively, the driller's cabin forms a unit with a drill floor element, thus forming a single unit, such that upon raising the drill floor to the elevated position, the drillers cabin is simultaneously raised to its operational position.

In an embodiment the drilling rig system is further provided with a locking mechanism that is adapted to lock the pedestal in its raised position, the locking mechanism comprising for example a locking bar that extends between the pedestal and the base structure.

In an embodiment the locking bar extends substantially diagonally. A lower end of the locking bar may be pivotally connected to the base structure, or the surface on which the base structure is positioned in the operational mode. An upper end of the locking bar may be connected to the pedestal or the drilling rig mast. Optionally, the locking bar is provided with a latch connecting the upper end to the pedestal in het raised position thereof, e.g. locking automatically when said position is reached.

In an embodiment the locking bar is provided with a damper, e.g. a hydraulic damper, to dampen motion of the drilling rig mast when reaching the vertical operational position.

Possibly, a guide or lifting mechanism is provided to guide and/or lift the foot of the drilling rig mast—when supplied in substantially horizontal position, e.g. lying on a trailer of a vehicle,—to the pedestal, e.g. the guide mechanism being adapted to raise said foot from its original height when lying on the trailer up to the pedestal. The lifting mechanism preferably enables the foot of the drilling rig mast to become aligned properly with the pedestal to allow their connection.

The present invention also relates to a method for bringing into operational mode a modular transfigurable drilling rig system according to one or more of claims 1-17, said method comprising the steps of:

- positioning the cross beam on the surface near the well centre,
- positioning the elongated base units on the surface adjacent the well centre;
- connecting the base units to the cross beam to form a C-arrangement when seen from above;
- connecting the pedestal to the base structure;
- positioning, possibly assembling, the drilling rig mast in the substantially horizontal connecting position and connecting the foot of the drilling rig mast to the pedestal;
- operating the at least one drive assembly such that the connected pedestal and drilling rig mast are pivoted as a unit from the substantially horizontal connecting position to the substantially vertical operational position, such that in the vertical operating position the drilling rig mast is positioned above the well centre.

The invention is further described in the claims and explained here below in relation to the drawings, in which:

Figure 1A:
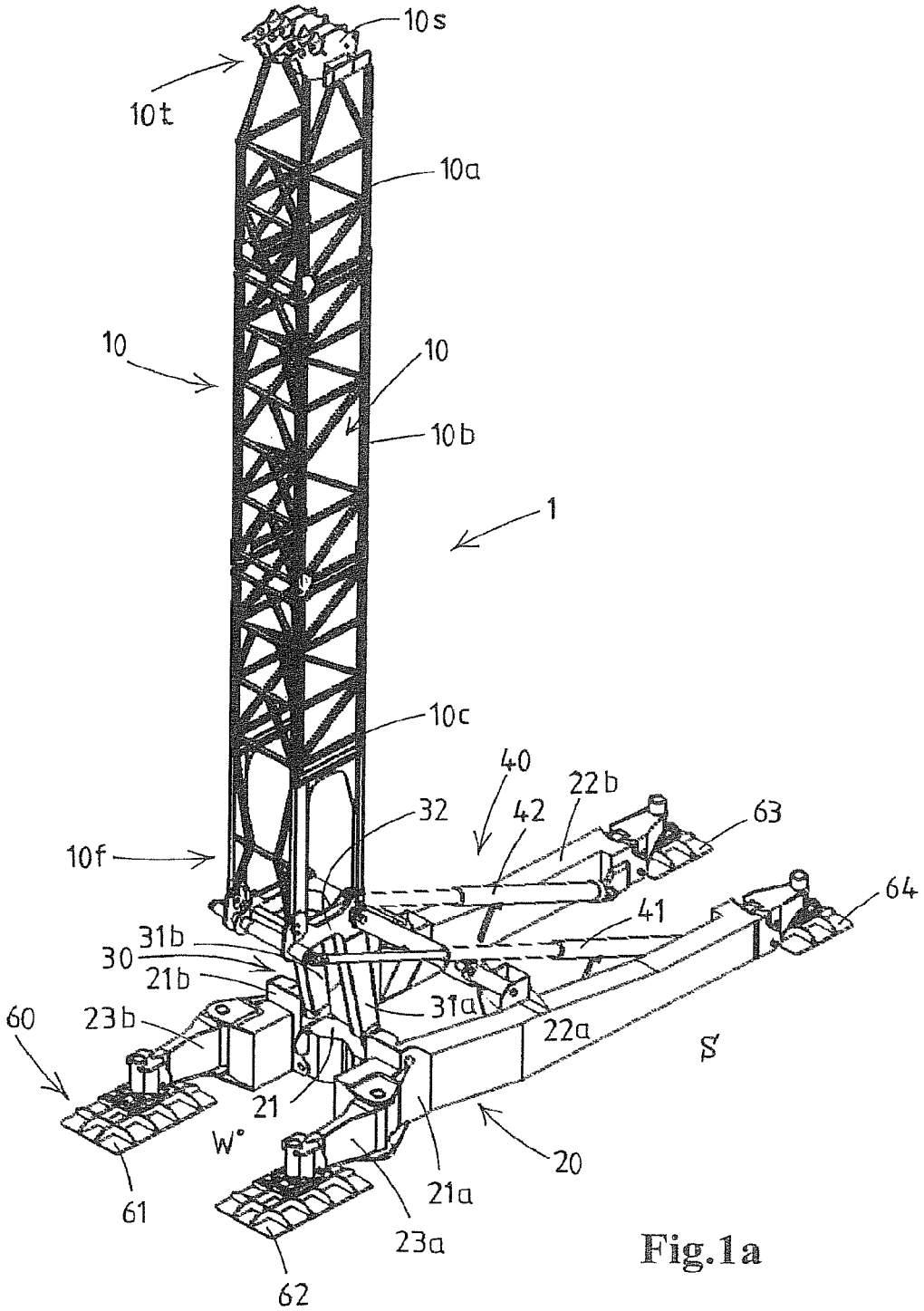
FIGS. 1A and 1B show a part of a modular transfigurable drilling rig according to the present invention in two different perspective views in an operational position.
Figure 1B:
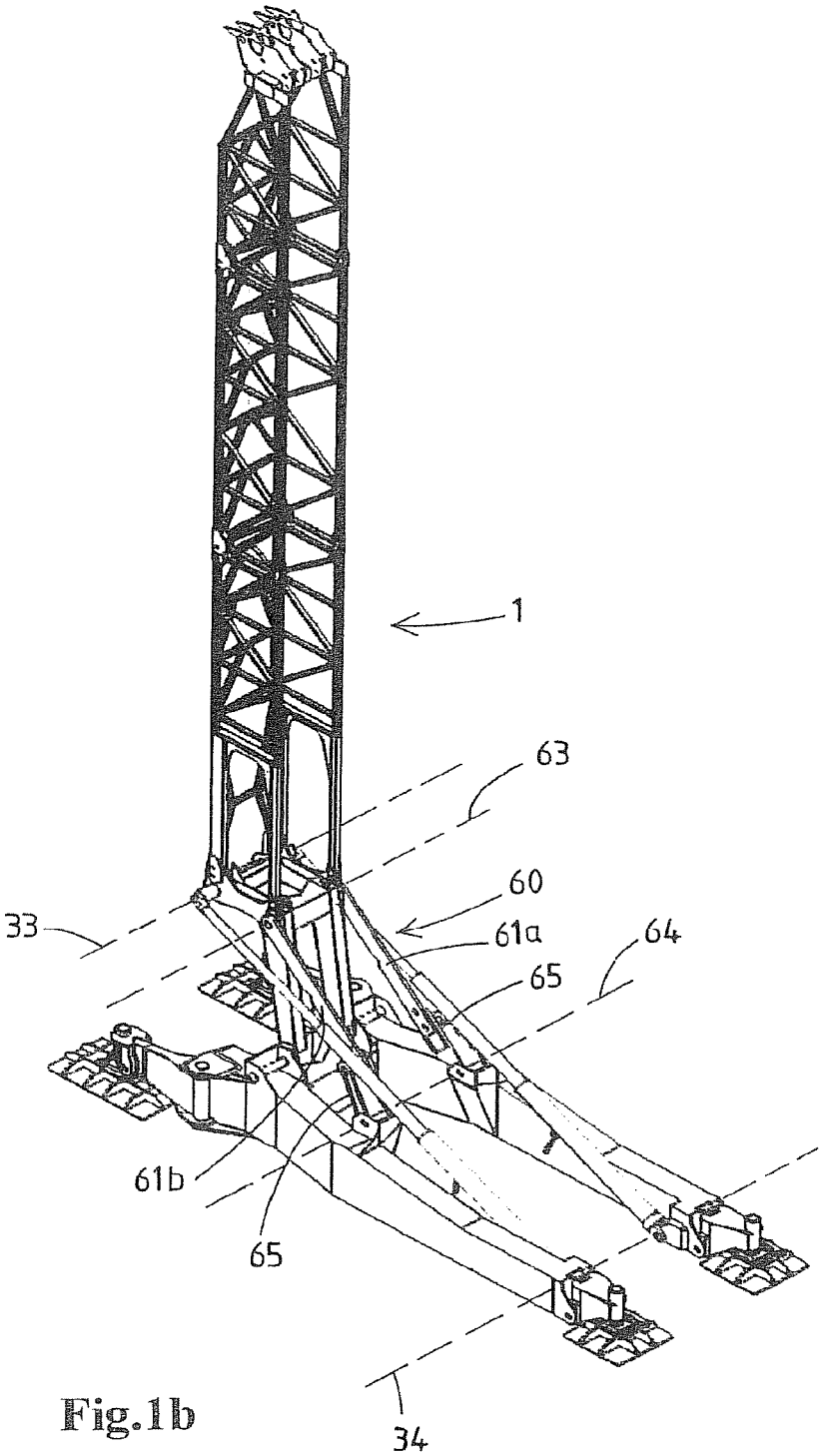
Figure 2:
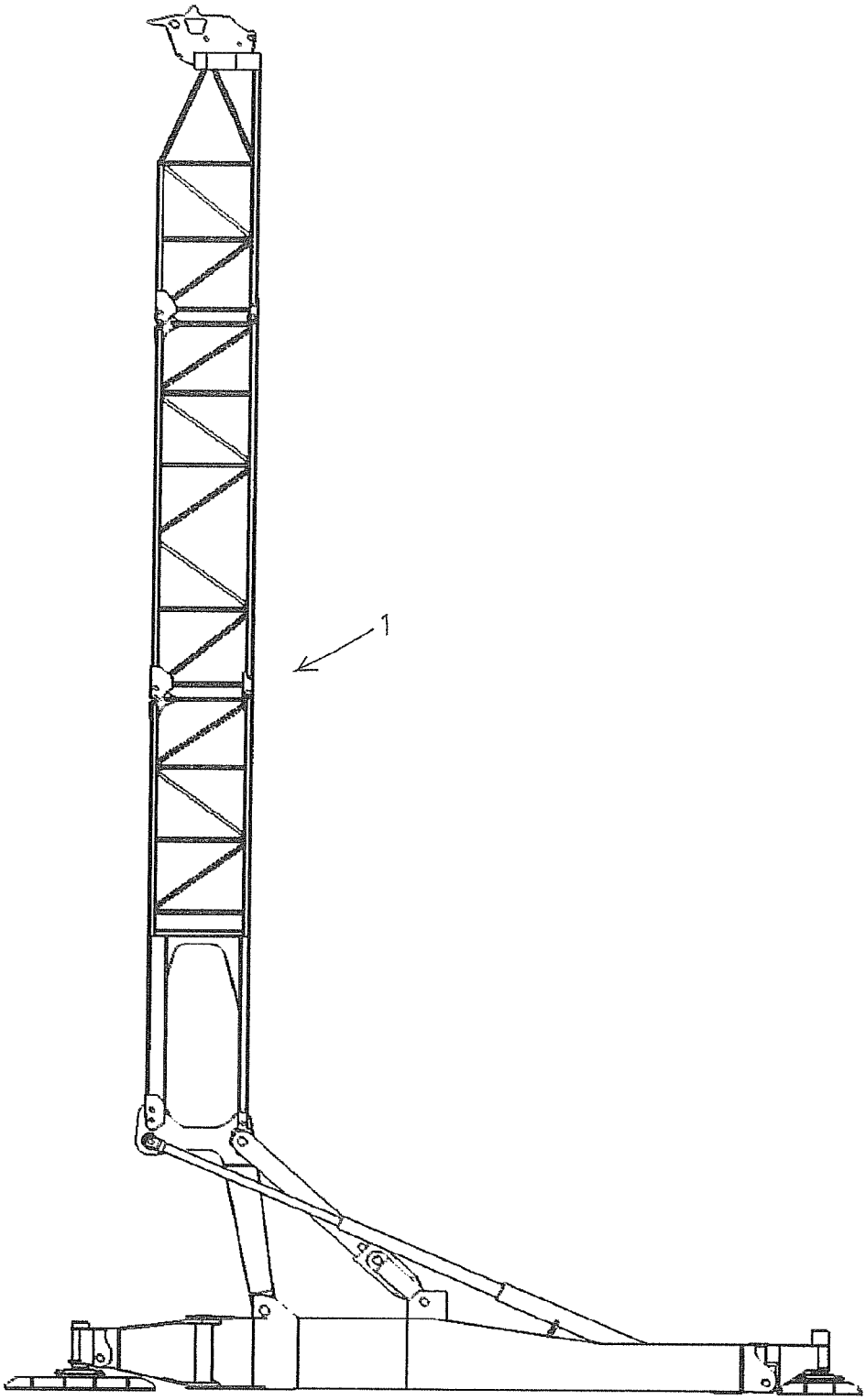
FIG. 2 shows part of a modular transfigurable drilling rig of FIGS. 1A and 1B in a side view.
Figure 3:
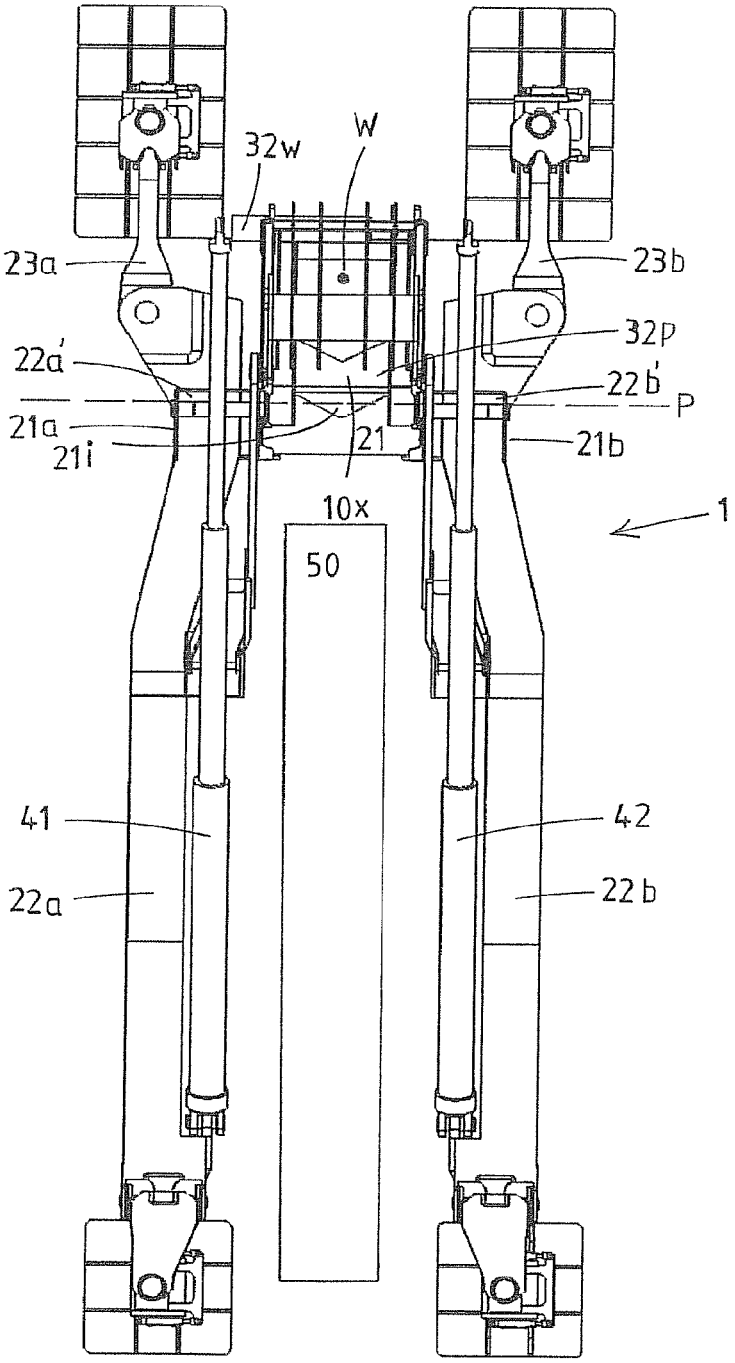
FIG. 3 shows part of a modular transfigurable drilling rig of FIGS. 1A and 1B, including a pipe loader in a top view.

In FIGS. 1A, 1B, 2 and 3 a modular transfigurable drilling rig 1 for drilling into a well centre W according to claim 1 is shown in different views in the operational mode. The modular transfigurable drilling rig 1 is transfigurable between a transport mode and an operational mode. In the transport mode the multiple components of the drilling rig system are transportable by vehicles, not shown. As a result, the dimensions and optionally also the weight of individual components is limited. In the operational mode the components are assembled to a drilling rig which is adapted to drill into a well centre in the ground. Such a drilling rig is shown in FIGS. 1-3.

The drilling rig 1 comprises a drilling rig mast 10, a pedestal 30 supported by a base structure 20 for supporting the drilling rig mast 1 above the well centre W and a drive assembly 40 to pivot the connected pedestal 30 and drilling rig mast 10 as a unit between a substantially horizontal connecting position (not shown) and the substantially vertical operational position (as visible in FIGS. 1-3), such that in the vertical operating position the drilling rig mast 10 is positioned above the well centre W. The drilling rig system further comprises a pipe loader 50 for loading pipes such as drill pipes and/or risers into the drilling rig mast 10. The pipe loader 50 can be any type of tubular handling apparatus, and is therefore only schematically indicated in FIG. 3.

The drilling rig mast 10 comprises a top end 10*t* and a foot 10*f*. In the shown embodiment, the drilling rig mast 10 is composed of three transportable mast sections, top section 10*a* comprising the top end 10*t*, middle section 10*b* and lower section 10*c* comprising the foot 10*f*. At the top end 10*t* of the drilling rig mast a sheave arrangement 10*s* is provided. The mast sections 10*a*, 10*b* and 10*c* of the shown embodiment have, as is preferred, a c-shaped cross-section with three latticed sides having vertical longitudinal columns at their corners and a lattice framework there between. The mast sections 10*a*, 10*b* and 10*c* of the shown embodiment thus have one open side 10*x*, said open side 10*x* facing downwards when the mast is held in generally horizontal position relative to the base structure. The open side 10*x* provides an opening, e.g. to allow for a top drive to be brought into the space within the contour of the mast sections. The open side 10*x* faces the opposite direction of the well centre W when the drilling rig mast is in the vertical operational position, allowing the entry of pipes by the pipe loader 50.

The base structure 20—here in the operational mode—is positioned on a surface S near the well centre W to support the drilling rig mast 1 thereon. The base structure comprises a cross beam 21 positioned on the surface S near the well centre W. The cross beam 21 has an essentially rectangular shape, in the shown embodiment a small indentation 21*i* at the side of the well centre W is visible. At the side opposite the well centre W the cross beam 21 is provided with two sets of connector members, here receptacles 21*a* and 21*b* at the distal ends of the cross beam, adapted to receive two elongated base units 22*a*, 22*b*. The connector members may be formed integral with the cross beam, or connected thereto. These base units 22*a*, 22*b* are placed on the surface S adjacent the cross beam 21. Each base unit 22*a*, 22*b* has an axial end face 22*a*', 22*b*', which is connected to the receptacles 21*a*, 21*b* respectively to connect the base units 22*a*, 22*b* to the cross beam 21. Thus, the cross beam 21 and the base units 22*a*, 22*b* form a C-arrangement when seen from above, with the legs of the C at the side remote from the well centre W, such that said base units 22*a*, 22*b* extend side-by-side with a spacing there between. This is in particular visible in the top view of FIG. 3. The space between the base units 22*a*, 22*b* is dimensioned to receive a vehicle carrying at least a foot portion of the drilling rig mast in its substantially horizontal connecting position, such that the foot of the drilling rig mast is arrangeable between the base units and connectable to the pedestal 30 in its substantially horizontal connecting position. As visible in FIG. 3, the space between the base units 22*a*, 22*b* is dimensioned to receive the pipe loader 50 when the drilling rig mast is in its substantially vertical operational position.

It is noted that cross beam 21 and base units 22*a*, 22*b* form three transportable components. The base structure 21 as shown further comprises two parallel support beams 23*a*, 23*b*, adapted to be positioned on the surface S perpendicular to the cross beam 21 and adjacent the well centre W. These support beams 23*a*, 23*b* may be pivotably connected to the base units 22*a*, 22*b*, to be transported as a unit, or transported separately and connected to the base units at the drilling site.

In the shown embodiment, the base structure 20 of the drilling rig 1 is further provided with a displacement system 60 to displace the drilling rig 1 with respect to the surface in a substantially horizontal direction. Here, the displacement system 60 comprises four displacement devices 61, 62, 63, 64 to displace the drilling rig. These displacement devices 61, 62, 63, 64 may be pivotably connected to the base units 22*a*, 22*b*, to be transported as a unit, or, as is more likely, transported separately and connected to the base units at the drilling site. Preferably, the displacement devices correspond to the devices disclosed in pending application PCT/NL2013/050026. This document describes displacement devices comprising: a displacement foot extendable and retractable in a substantially vertical direction between an extended position, in which the displacement foot is arranged on the support surface, and a retracted position, in which the displacement foot is free from the support surface. The displacement foot comprises a lift actuator to move the displacement foot between the retracted position and the extended position, wherein said displacement foot comprises a lower part and an upper part, wherein said lower part is configured to be placed on the support surface, and wherein said upper part is connected to the drilling rig. The lower part is movable with respect to the upper part in at least one substantially horizontal direction, and wherein said displacement foot comprises one or more displacement actuators to move the lower part and the upper part with respect to each other in the at least one substantially horizontal direction.

The drilling rig 1 further comprises a pedestal 30, which is supported by the base structure 20 and supports the drilling rig mast 1 above the well centre W. The pedestal is operable to pivot between the substantially horizontal connecting position and a substantially vertical operational position, to be able to move the drilling rig mast 1 of the modular transfigurable drilling rig from the substantially horizontal connecting position to the operational position in which the drilling rig mast 1 is provided substantially vertically above the well centre W. To this end, the pedestal 30 is provided which is adapted to be—in a substantially horizontal connecting position thereof—pivotally connected at a lower end thereof to said base structure 20. In the shown embodiment, the pedestal 30 is formed as a single unit comprising two arms 31*a*, 31*b*, which are at a lower end thereof pivotally connected to said base structure 20. Here, the arms 31*a*, 31*b* are connected to the cross beam 21, which is advantageous in view of torsion forces. Alternatively, the pedestal could be connected to the base units. In particular, the arms 31*a*, 31*b* are here connected to the cross beam 21 adjacent the receptacles 21*a*, 21*b*, about a pedestal pivot axis P.

In the shown embodiment, a cantilevered mast support 32 is connected to upper ends of the arms 31*a*, 31*b*, or formed integral therewith. The cantilevered mast support 32 extends forward of the arms 31*a*, 31*b* in the substantially vertical operational position as shown. The cantilevered mast support 32 is adapted to be—in the substantially horizontal connecting position—connected to the foot 10*f* of the drilling rig mast 1 and adapted to—in the substantially vertical operational position—support the drilling rig mast 1 above the well centre W.

The drilling rig system is further provided with a drive assembly 40 to pivot the connected pedestal 30 and drilling rig mast 10 as a unit between a substantially horizontal connecting position (not shown) and the substantially vertical operational position (as visible in FIGS. 1-3). Drive assembly 40 is here composed of two hydraulic jacks 41, 42, extending from base units 22*a*. 22*b*, respectively, to the cantilevered mast support 32, extending substantially diagonally in the space. In particular, the hydraulic jacks 41, 42 extend to a side 32*w* of the cantilevered mast support 32 which is adjacent the well centre W, opposite to the pipe loader side 32*p* of the cantilevered mast support 32. Specifically, the hydraulic jacks 41, 42 are rotatably connected to the side 32*w* of the cantilevered mast support 32 via pivot axis 33, and rotatably connected to the base units about pivot axis 34.

Alternatively, a drive assembly may be integrated into a base unit, and comprises e.g. a winch, e.g. a hydraulic powered winch, and a cable connected to said winch, as described in priority application U.S. 61/607,309, herewith incorporated by reference.

As is preferred, the drilling rig system is further provided with a locking mechanism 60 that is adapted to lock the pedestal 30 in its raised position. In the shown embodiment, the locking mechanism 60 comprises parallel locking bars 61*a*, 61*b*, that extend between the pedestal 30 and the base structure 2, here extending substantially diagonally in the space. In particular, the upper end of the locking bars 61*a*, 61*b* is connected pivotably to the cantilevered mast support 32 of the pedestal, in particular at the pipe loader side 32*p* via pivot axis 63. Not visible, but preferably the upper end of the locking bars 61*a*, 61*b* is provided with a latch connecting the upper end to the pedestal 30 in the raised position thereof, e.g. locking automatically when said position is reached. The lower end of the locking mechanism is connected pivotably to the base units 22*a*, 22*b*, about pivot axis 64. As is preferred, the locking bars 61*a*, 61*b* are provided with dampers 65, e.g. a hydraulic damper, to dampen motion of the drilling rig mast 1 when reaching the vertical operational position.

Figure 4:
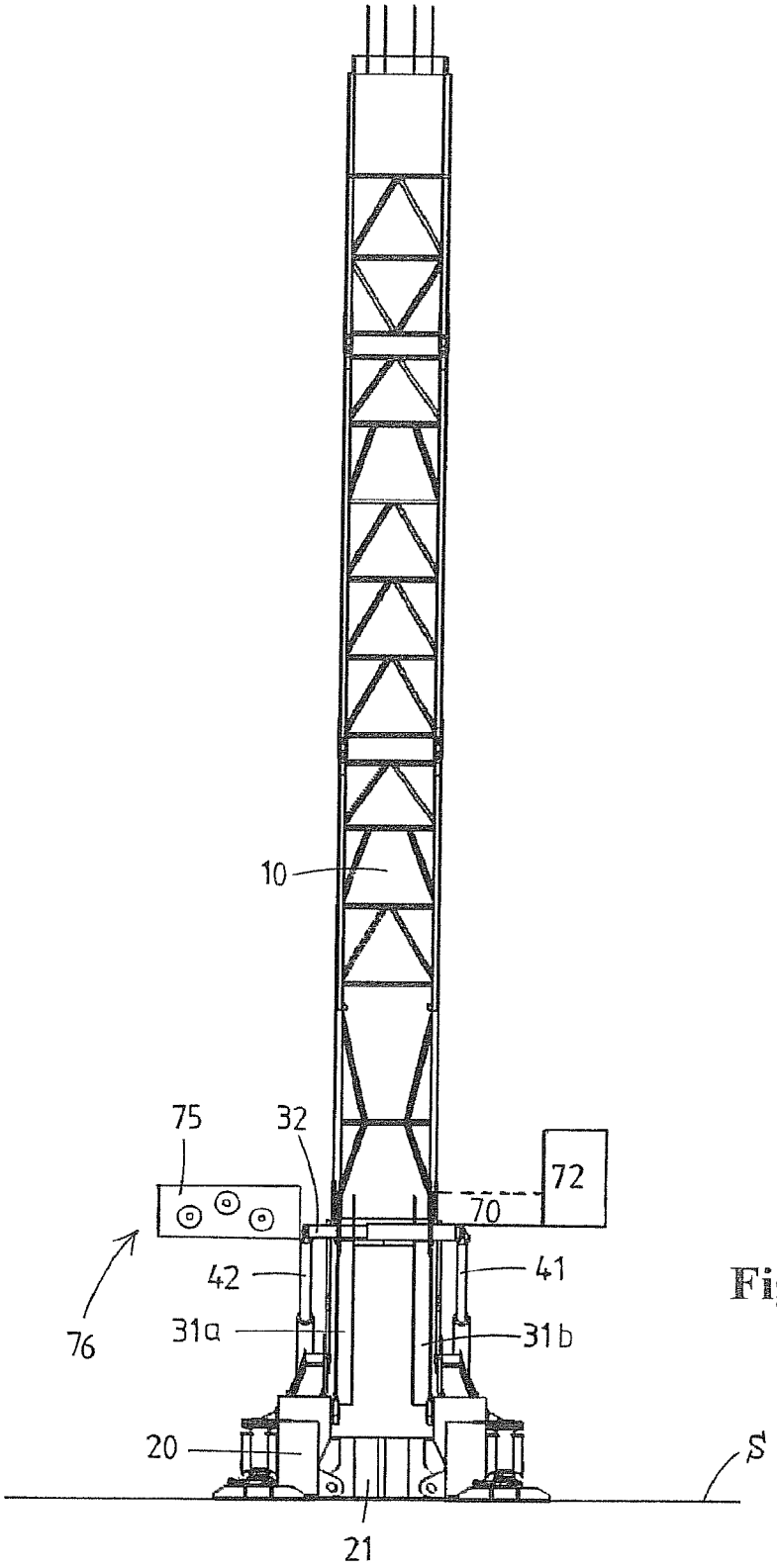
FIG. 4 shows part of a modular transfigurable drilling rig of FIGS. 1A and 1B, including a drillers cabin, a drill floor and drilling drawworks in a front view.

In FIG. 4 the modular transfigurable drilling rig 1 is shown in the operational mode in a front view. In this embodiment, also a drill floor member 70 is provided, forming part of a drill floor in the operational mode. The drill floor member 70 is located at an elevated position above said base structure 20 and pedestal 30, and connected directly to the drilling rig mast 10, once it is in the vertical operating position thereof. Optionally, the drill floor member is also supported by the cantilevered mast support 32 of the pedestal. On the drill floor member 70 of the shown embodiment, a drillers cabin 72 is provided.

In FIG. 4 also drilling drawworks 75 of the modular transfigurable drilling rig system is provided. In this embodiment, the drawworks 75 are connected to the pedestal, in particular to the cantilevered mast support 32 of the pedestal. Alternatively, the drilling rig mast may be provided with drawworks connection members, to connect the drawworks to the drilling rig mast. Advantageously, the drilling drawworks are provided at an elevated drawworks position 76, above the surface S, such that the surface, in particular adjacent the well centre, is clear.

Another advantage of the elevated drawworks position 76 is that the drawworks can be displaced together with the drilling rig system, upon actuation of the displacement devices 61, 62, 63, 64.

The invention claimed is:

1. A modular transfigurable drilling rig system composed of multiple components, which system is transfigurable between a transport mode in which the components of the system are transportable by vehicles and an operational mode in which the components are assembled to a drilling rig which is adapted to drill into a well center in the ground, the system comprising:

a drilling rig mast which is movable between a substantially horizontal connecting position and a substantially vertical operational position above the well center, the drilling rig mast having a top end and a foot;

a base structure adapted to be positioned in the operational mode on a surface near the well center to support the drilling rig mast thereon, the base structure comprising an assembly of interconnected parts, including:

a cross beam adapted to be positioned on the surface near the well center;

two support beams placed on the surface defining a first space configured to accommodate the well center, the two support beams extending in a first direction; and at least two elongated base units placed on the surface extending in a second direction opposite to the first direction and away from the first space defined by the two support beams, and defining a second space, the second space being dimensioned to receive a vehicle carrying at least a foot portion of the drilling rig mast in the substantially horizontal connecting position;

wherein the base structure is formed in an H shape in the operational mode;

a pedestal, comprising:

an arm adapted to be, in a substantially horizontal connecting position thereof, pivotally connected at a lower end thereof to the base structure, about a pedestal pivot axis; and a cantilevered mast support connected to an upper end of the arm, the cantilevered mast support extending upwardly and being connected to the foot of the drilling rig mast in the substantially horizontal connecting position of the pedestal, and extending forward of the arm in the first direction and supporting the drilling rig mast above the well center in the substantially vertical operational position, wherein the pedestal is operable to pivot between the substantially horizontal connecting position and the substantially vertical operational position, at least one drive assembly configured to pivot the connected pedestal and drilling rig mast as a unit between the substantially horizontal connecting position and the substantially vertical operational position, such that in the vertical operating position the drilling rig mast is positioned above the well center; and a pipe loader for loading pipes into the drilling rig mast, the pipe loader being received in the second space between the at least two elongated base units when the drilling rig is in the substantially vertical operational position.

2. The system according to claim 1, further comprising one or more drill floor members adapted to form a drill floor in the operational mode, said drilling floor in the operational mode being located at an elevated position above said base structure, wherein the one or more drill floor members are adapted to be installed in the drilling rig mast once it is in the vertical operating position thereof.

3. The system according to claim 1, wherein said drive assembly engages on the pedestal.

4. The system according to claim 3, wherein the drive assembly includes one or more hydraulic jacks.

5. The system according to claim 4, wherein the cantilevered mast support includes a first end connected to an upper end of the arm, and a second end extending toward the first space, and the one or more hydraulic jacks extends to the second end of the cantilevered mast support.

6. System according to claim 1, further comprising a locking mechanism that is adapted to lock the pedestal in its raised position, the locking mechanism comprising a locking bar that extends between the pedestal and the base structure.

7. The system according to claim 6, wherein an upper end of the locking bar is provided with a latch connecting the upper end to the pedestal in the raised position thereof.

8. The system according to claim 7, wherein the locking bar is provided with a damper, to dampen motion of the drilling rig mast when reaching the vertical operational position.

9. The system according to claim 1, further comprising drilling drawworks, and wherein the drilling rig mast or the pedestal is provided with drawworks connection members adapted to connect the drawworks to the drilling rig mast or the pedestal at an elevated drawworks position.

10. The system at least according to claim 9, wherein the pedestal with the drilling mast connected thereto is operable to move from the substantially horizontal connecting position, via the substantially vertical operational position to a tilted position beyond the vertical operating position thereof, in which position the drilling rig mast is able to connect the drilling drawworks to the drilling rig mast.

11. The system according to claim 10, wherein the drilling rig mast is provided with a hoist device adapted to hoist a drilling drawworks—with the drilling rig mast in its vertical operational position—to the elevated drawworks position on the drilling rig mast.

12. The system according to claim 1, wherein the system comprises a guide mechanism to guide the foot of the drilling rig mast—when supplied in substantially horizontal position—to the pedestal.

13. The system according to claim 1, wherein the system comprises a lifting mechanism to lift the foot of the drilling rig mast, when supplied in substantially horizontal position, to the pedestal.

14. The system according to claim 1, wherein the drilling rig mast is composed of multiple transportable mast sections, and wherein the drive assembly is adapted to move the drilling rig mast composed from said mast sections in substantially horizontal orientation from said horizontal position to its vertical operational position.

15. The system according to claim 1, wherein the pedestal is shaped as an inverted L.

16. A method for bringing into operational mode a modular transfigurable drilling rig system according to claim 1, said method comprising the steps of:

positioning the cross beam on the surface near the well center;

positioning the elongated base units on the surface adjacent the well center;

positioning the base units to form a H-shaped base structure when seen from above;

connecting the pedestal to the base structure;

positioning the drilling rig mast in the substantially horizontal connecting position and connecting the foot of the drilling rig mast to the pedestal; and operating the at least one drive assembly such that the connected pedestal and drilling rig mast are pivoted as a unit from the substantially horizontal connecting position to the substantially vertical operational position, such that in the vertical operating position the drilling rig mast is positioned above the well center.

* * * * *